US008286544B2

(12) United States Patent
Djurovic et al.

(10) Patent No.: US 8,286,544 B2
(45) **Date of Patent: *Oct. 16, 2012**

(54) HYDRAULIC CONTROL SYSTEM

(75) Inventors: Milan Djurovic, Stuttgart (DE); Gerhard Keuper, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 1002 days.

This patent is subject to a terminal disclaimer.

(21) Appl. No.: 12/280,092

(22) PCT Filed: Jan. 17, 2007

(86) PCT No.: PCT/EP2007/000352

§ 371 (c)(1), (2), (4) Date: Aug. 20, 2008

(87) PCT Pub. No.: WO2007/096030

PCT Pub. Date: Aug. 30, 2007

(65) Prior Publication Data

US 2009/0007556 A1 Jan. 8, 2009

(30) Foreign Application Priority Data

Feb. 23, 2006 (DE) ..... 10 2006 008 940

(51) Int. Cl.
*F15B 11/16* (2006.01)

(52) U.S. Cl. ..... 91/516

(58) Field of Classification Search ..... 91/516
See application file for complete search history.

(56) References Cited

U.S. PATENT DOCUMENTS

| | | | | |
|---|---|---|---|---|
| 3,587,630 | A | 6/1971 | Parquet | |
| 4,070,857 | A * | 1/1978 | Wible | 91/516 |
| 4,977,928 | A * | 12/1990 | Smith et al. | 91/516 |
| 5,493,861 | A | 2/1996 | Friedrichsen | |
| 7,984,611 | B2 * | 7/2011 | Djurovic et al. | 60/422 |

FOREIGN PATENT DOCUMENTS

| | | |
|---|---|---|
| DE | 41 27 342 | 2/1993 |
| DE | 10 2004 048 684 | 4/2006 |
| EP | 1 245 834 | 10/2002 |

* cited by examiner

*Primary Examiner* — Daniel Lopez
(74) *Attorney, Agent, or Firm* — Michael J. Striker

(57) ABSTRACT

A hydraulic control system for controlling at least two consumers (2, 4) includes a pump (6) with an adjustable delivery quantity. The consumers are each associated with an adjustable metering orifice (24, 38), having a power beyond connection (72) to which at least one power beyond consumer (74) is connectable. An inlet pressure governor unit (60) is connected downstream of the pump (6) and opens a connection to a tank (T). Its setting occurs as a function of a load pressure of the consumers (2, 4) or of the at least one power beyond consumer (74). The inlet pressure governor (60) is provided in the pressure fluid flow path between the pump (6) and one of the two consumers (2, 4), while the power beyond connection (72) branches off from the pressure fluid path between the pump (6) and the inlet pressure governor (60).

14 Claims, 7 Drawing Sheets

Fig. 1
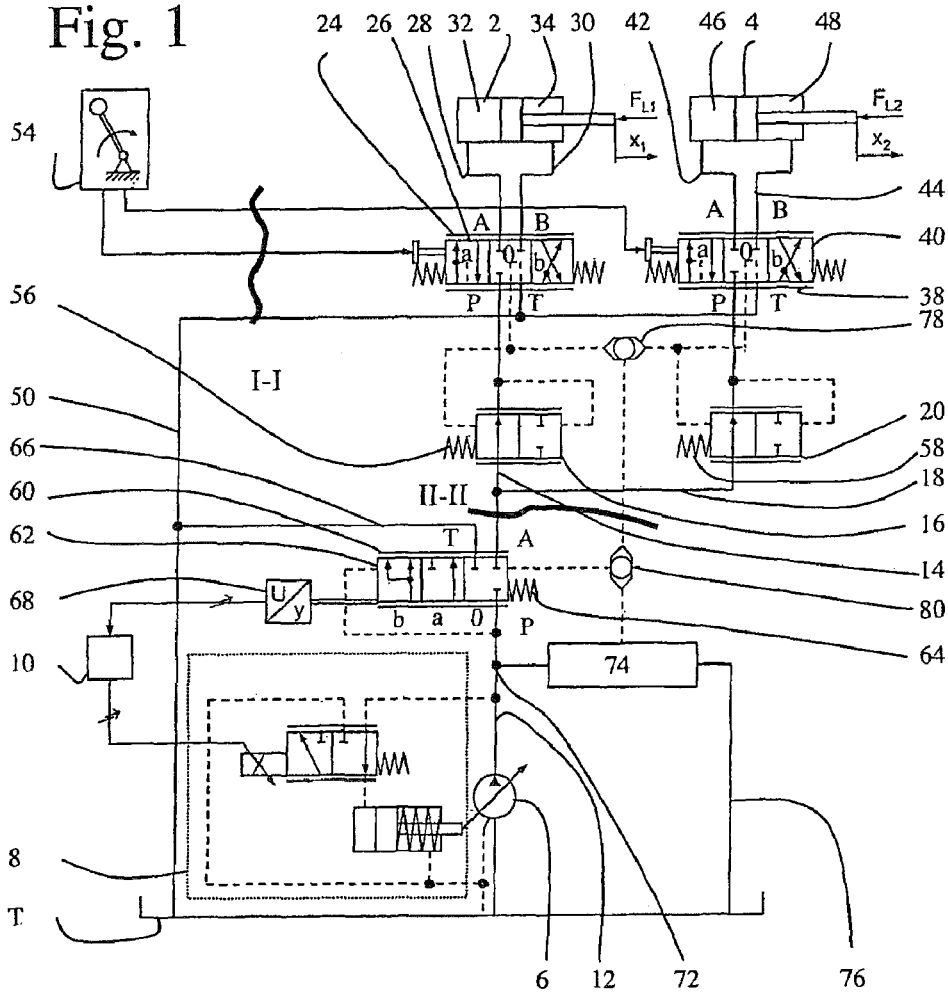
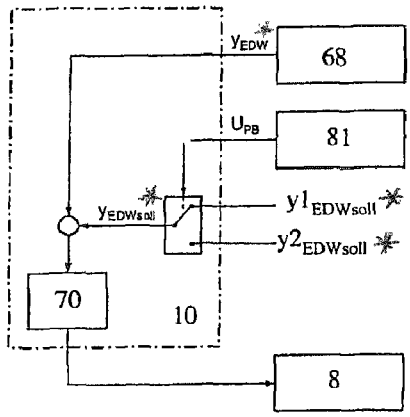
Fig. 2
*EDW = IPG (inlet pressure governor)
**EDWsoll – IPG target

*EDW = IPG (inlet pressure governor)

**EDWsoll – IPG target

*EDW = IPG (inlet pressure governor)

**EDWsoll – IPG target

*EDW = IPG (inlet pressure governor)

**EDWsoll – IPG target

*EDW = IPG (inlet pressure governor)

HYDRAULIC CONTROL SYSTEM

BACKGROUND OF THE INVENTION

The invention relates to a hydraulic control system for controlling a plurality of consumers and to a pressure governor for such a hydraulic control system.

Hydraulic control systems according to the present invention are used particularly in mobile machines such as wheel loaders or tractors in order to supply pressure fluid to their consumers, e.g. the working hydraulics, the steering, traveling mechanisms, and/or accessories. DE 41 27 342 C2 has disclosed hydraulic control systems that are embodied in the form of LS systems. In LS systems of this kind, the delivery quantity of the pump is regulated so that in the pump line, a pump pressure prevails that lies a certain pressure difference $\Delta p$ above the maximum load pressure of the consumers. In the known systems, each consumer is associated with an adjustable metering orifice and an individual pressure governor by means of which the volumetric flow of pressure fluid to the consumer can, independent of the load, be kept constant as a function of the setting of the metering orifice. In these LS systems, downstream of the pump, an inlet pressure governor can be provided, which can open a connection to the tank. These inlet pressure governors are acted on in the closing direction by a control pressure that corresponds to the maximum load pressure. The pressure difference at which the inlet pressure governor opens is as a rule set slightly higher than the pressure difference $\Delta p$ set by means of the pump.

In order to connect attached devices or accessories that do not have their own supply of pressure fluid, a so-called power beyond connection is provided, which can have a pressure line, a return line, and an LS line. This power beyond connection permits the load-sensing system of the machine to also be used for the attached device.

DE 10 2004 048 684 is an example of a hydraulic control system provided with a power beyond connection. In this control system, the pump connection of a power beyond pressure governor is provided in a flow path between the pressure connection of the pump and the pump connections of the pressure governors of the other consumers. The power beyond pressure governor is connected in series with the power beyond consumer. A disadvantage of this known embodiment is the fact that the activation of the power beyond consumer can lead to uncontrolled behavior of one or more consumers, particularly in the event of an undersupply. Since the volumetric flow demand of the power beyond consumer is not as a rule known, the valve control and pump control cannot be adapted to the requirements of the power beyond consumer.

In relation to this prior art, the object of the invention is to create a hydraulic control system suitable for this purpose as well as a control method, which both assure a demand-actuated pressure fluid supply to all consumers when at least one power beyond consumer is connected to a power beyond connection.

According to the invention, a hydraulic control system is provided for controlling at least two consumers that can be supplied with pressure fluid by a pump with an adjustable delivery quantity and that are each associated with an adjustable metering orifice. This hydraulic control system is preferably used in mobile machines and has a power beyond connection for the connection of a power beyond consumer and one inlet pressure governor, which is connected downstream of the pump. This inlet pressure governor can open a connection to the tank and can be adjusted as a function of a load pressure of the consumer or of the at least one power beyond consumer. The placement of the inlet pressure governor in the pressure fluid flow path between the pump and at least one of the consumers as well as the branching of the power beyond connection from a pressure fluid flow path between the pump and the inlet pressure governor assures a prioritized supply of the power beyond consumer.

The pump can preferably be controlled as a function of the setting of the inlet pressure governor, thus yielding a demand-actuated supply of the consumers. In particular, the pump is controlled as a function of the position of a control piston of the inlet pressure governor thus permitting a precise regulation to be carried out in an inexpensive fashion.

A control of the pump as a function of the volumetric flow in a connection of the inlet pressure governor permits direct sensing of hydraulic parameters in order to selectively influence the pump regulation with favorable dynamic properties.

A signal for triggering the metering orifice of at least one consumer can also be used as a parameter for the pump control. As a result, the position and/or residual flow regulation of the inlet pressure governor no longer has to compensate for any more than relatively slight regulating deviations.

Preferably, the maximum of the load pressures acts on the inlet pressure governor in the closing direction so that the load sensing system of the consumers can also be used for the power beyond consumer.

According to an advantageous modification of the invention, the inlet pressure governor closes the connection to at least one consumer and the tank in a spring-prestressed starting position; when moved in the opening direction, it opens the connection to at least one of the two consumers and when moved further in the opening direction, opens the connection to the tank. A sufficient supply to all consumers is then assured if the residual volumetric flow is discharged to the tank via the open inlet pressure governor.

The inlet pressure governor is preferably acted on in the closing direction by the force of at least one spring and by the maximum of the load pressures and is acted on in the opening direction by the pressure at the inlet of the inlet pressure governor.

In a preferred control system, the inlet pressure governor is provided with a spring packet or a progressive spring for acting on it in the closing direction and for switching the regulating pressure difference, thus making it possible to implement a travel-dependent change in the spring force on a control piston of the inlet pressure governor.

According to another preferred embodiment of the present invention, in order to increase the regulating pressure difference, the control system is provided with a device for increasing the prestressing force of the spring, which produces this increase mechanically, hydraulically, or electrically. This permits the control of the inlet pressure governor to be adapted to special structural circumstances and permits the control of the inlet pressure governor control piston to also be implemented over greater distances by the operator of a machine.

The pump is preferably an electrically controllable variable displacement pump or a speed-regulated fixed displacement pump, thus making it possible to implement the pump regulation in an inexpensive fashion.

It is particularly advantageous if each metering orifice has an individual pressure governor connected upstream of it, which can be acted on in the opening direction by the respectively associated load pressure of the associated consumer and by a pressure governor spring and can be acted on in the closing direction by the pressure at the outlet of the individual pressure governor. This yields a rapidly reacting load sensing system.

The metering orifices are preferably comprised of electrically, hydraulically, or mechanically movable directional control valves.

According to the invention, a pressure governor is also provided for one of the control systems described above; the control piston of this pressure governor can be acted on in the closing direction by a pressure governor spring arrangement and can be acted on in the opening direction by a load pressure. This pressure governor spring arrangement preferably has two springs that can be brought into engagement one after the other and that make it possible for the inlet pressure governor to take up a small amount of installation space.

In a control method according to the invention, the regulating pressure difference at the inlet pressure governor is increased with the activation of the power beyond consumer so that in addition to the prioritization of the power beyond consumer, an increase in the regulating pressure difference is also assured in order to permit a reliable operation of attached devices, even in the event of significant pressure drops in the line system leading to the attached device.

Advantageous modifications of the invention are the subject of the dependent claims.

BRIEF DESCRIPTION OF THE DRAWINGS

FIGS. 1 and 2 show a hydraulic control system corresponding to the first exemplary embodiment.

DETAILED DESCRIPTION OF THE PREFERRED EMBODIMENTS

Figure 3:
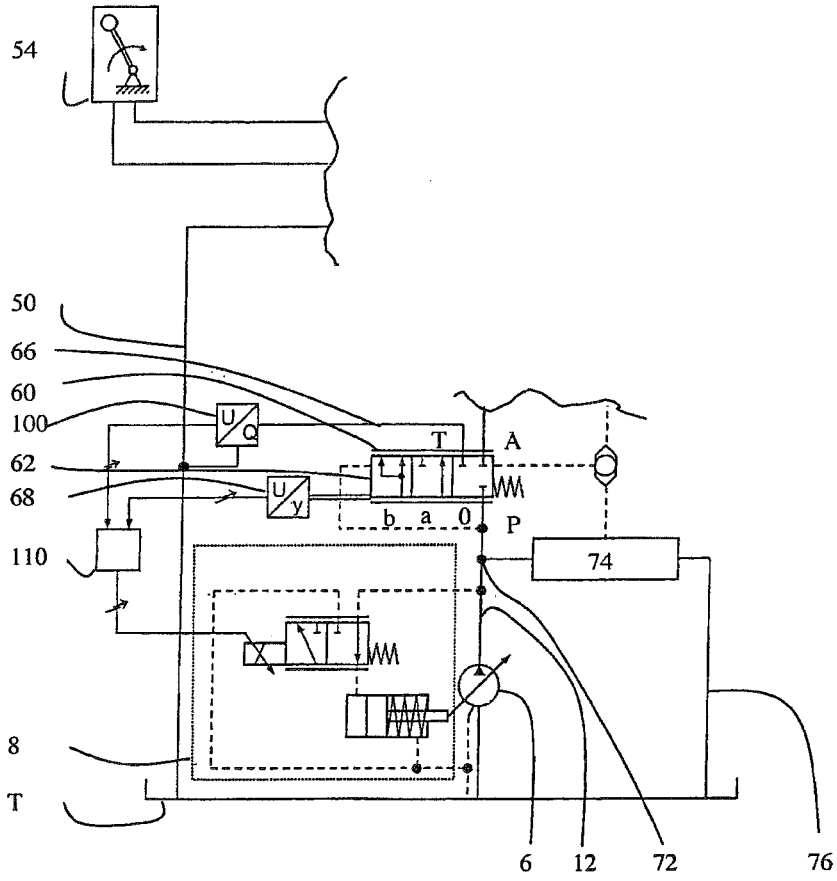
FIGS. 3 and 4 show a hydraulic control system corresponding to a second exemplary embodiment of the invention.

FIG. 1 shows a hydraulic control system of a mobile machine, for example a farming tractor. This control system can, for example, be composed of a mobile control block that supplies the hydraulic consumers of the set of working hydraulics—in this instance two dual-action cylinders 2, 4—with pressure fluid that a pump 6 delivers and that is returned from the consumers 2, 4 to a tank T. In the exemplary embodiment shown, the pump 6 is embodied in the form of an electrically controllable variable displacement pump whose pivot angle can be adjusted by means of a pump regulator 8. In lieu of an electrically controllable variable displacement pump, it is also possible to use a speed-regulated fixed displacement pump or another pump that can be controlled by means of a pump regulator.

The pressure fluid that the pump 6 draws from the tank T is fed into a pump line 12 that branches into two inlet lines 14, 18; the inlet line 14 is associated with the cylinder 2 and the inlet line 18 is associated with the cylinder 4. In the inlet line 14 leading to a continuously adjustable directional control valve 24, an individual pressure governor 16 is provided, with the directional control valve 24 serving to set the pressure fluid flow direction to and from the consumer and to adjust the volumetric flow of pressure fluid. In the inlet line 18 leading to a continuously adjustable directional control valve 38, an individual pressure governor 20 is provided, with the directional control valve 38 serving to set the pressure fluid flow direction to and from the consumer and serving to adjust the volumetric flow of pressure fluid. The working connections A, B of the directional control valve 24 are connected to a supply line 28, which is connected to a bottom-end cylinder chamber 32 of the cylinder 2, and a return line 30, which is connected to an annular chamber 34 at the piston rod end of the cylinder 2. The working connections A, B of the directional control valve 38 are connected to a supply line 42, which is connected to a bottom-end cylinder chamber 46 of the cylinder, and a return line 44, which is connected to an annular chamber 48 at the piston rod end of the cylinder 4.

The control piston 26 of the directional control valve 24 and the control piston 40 of the directional control valve 38 are controlled by a preliminary control unit 54 or through manual actuation. The actuation of the preliminary control unit 54 or manual actuation adjusts the control pressure difference so that the respective control piston 26 or 40 is moved out of the closed position (0) shown in FIG. 1 toward the indicated positions (a) or (b) in which either the cylinder chamber 32, 46 or the annular chamber 34, 48 is supplied with pressure fluid, while the pressure fluid is displaced from the respective other pressure fluid chamber. In this case, an inlet control edge opens an inlet metering orifice into the directional control valves 24, 38 and the opening cross section of the respective metering orifice determines the volumetric flow of pressure fluid to the cylinder 2, 4. The pressure fluid flowing back from the cylinder 2, 4 is conveyed back to the tank T via a tank connection T on the respective directional control valve 24, 38 and a tank line 50 connected to it.

The individual pressure governors 16, 20 are each acted on in the opening direction by the force of a pressure governor spring 56, 58 and by the load pressure present at the respective consumer 2, 4. The respective pressure governor slider of each of the individual pressure governors 16, 20 is acted on in the closing direction by the pressure in the respective inlet line 14 or 18 between the outlet of the respective individual pressure governor 16, 20 and the inlet of the subsequent directional control valve 24, 38. The respective individual pressure governor 16, 20 and the associated metering orifice, which is embodied by the respective directional control valve 24, 38, constitute a flow regulator by means of which the pressure drop via the metering orifice can be kept constant, independent of the load.

A hydraulic control system according to the above description relating to FIG. 1 essentially corresponds to the design of the hydraulic control system from DE 10 2004 048 684. According to the present invention, an inlet pressure governor 60, which is embodied in the form of a 3/3-way pressure governor, is provided in the pump line 12 between the pressure connection of the pump 6 and the branch point of the inlet lines 14, 18.

A power beyond connection 72 branches off from the section of the pump line 12 situated between the pressure connection of the pump 6 and the inlet connection P of the inlet pressure governor 60. This power beyond connection 72 makes it possible to connect one or more additional hydraulic power beyond consumers 74 to the mobile machine, for example a self loading forage box or a potato harvester.

The power beyond consumer 74 also has a pressure fluid connection to the tank T via a tank conduit 76. The load pressure of the power beyond consumer 74 is tapped by means of a shuttle valve 80 of a shuttle valve cascade composed of a shuttle valve 78 and a shuttle valve 80 of the LS line.

The control piston 62 of the inlet pressure governor 60 is acted on in the closing direction by the force of a spring 64 and by the maximum of the load pressures of the two consumers 2, 4 and of the power beyond consumer 74. The maximum of the load pressures of the consumers 2, 4 is tapped by means of a shuttle valve 78 and then supplied to the shuttle valve 80, which is also acted on by the load pressure of the power beyond consumer 74.

The pressure in the pump line 12 acts on the control piston 62 of the inlet pressure governor in the opening direction. The inlet connection P of the inlet pressure governor 60 has a pressure fluid connection to the pump line 12, while the working connection A of the inlet pressure governor 60 is connected to the inlet lines 14, 18. The tank connection T of the inlet pressure governor 60 has a pressure fluid connection to the tank line 50 via a tank conduit 66.

In the closed position (0) of the inlet pressure governor 60 shown in FIG. 1, there is no pressure fluid connection between the pump connection P, the working connection A, and the tank connection T. The stress of the spring 64 acts on the control piston 62 of the inlet pressure governor 60 in the direction of its closed position (0). In the working position (a), there is a pressure fluid connection between the pump connection P and the working connection A, while the pressure fluid connection to the tank connection T is closed. In the working position (b) adjacent to the working position (a), there is a pressure fluid connection between the pump connection P, the working connection A, and the tank connection T.

The position of the control piston 62 of the inlet pressure governor 60 is detected by a travel sensor 68, whose output signal is transmitted to a control unit 10 that controls the pump regulator 8.

The actuation of the pump regulator 8 by means of the control unit 10 will be described in greater detail with reference to FIG. 2. The control unit 10 is supplied with a target value $y1_{IpGtarget}$ and $y2_{IPGtarget}$. The system switches between these two target values as a function of the activation of a power beyond control 81. When the power beyond consumer 74 is not connected to the power beyond connection 72 or else the power beyond consumer 74 is not acknowledged, $y1_{IPGtarget}$ is used as the target value, whereas when the power beyond consumer 74 is connected and acknowledged, the target value $y2_{IPGtarget}$ is used. The power beyond control 81 is initialized by means of a signal from a user $U_{PB}$.

The respective target value is compared to the output signal $Y_{IPG}$ of the travel sensor 68 and supplied to a regulator 70 in the control unit 10. The target value $y1_{IPGtarget}$ is selected in such a way that when the power beyond consumer 74 is not connected or is not activated, with the target value $y1_{IPGtarget}$, the position (a) of the control slider 62 of the inlet pressure governor 60 is considered to be the target value, whereas when the power beyond consumer 74 is connected and activated, with the target value $y2_{IPGtarget}$, the position (b) of the control slider 62 of the inlet pressure governor 60 is set.

The position (a) of the inlet pressure governor 60 assures that the pump 6 supplies the pressure fluid to the consumers 2, 4 in a low-loss fashion via the inlet pressure governor 60, whereas with activation of the power beyond consumer 74, the inlet pressure governor 60 is brought into the position (b) in which, with a suitable setting of the pump 6, a low residual volumetric flow is discharged via the tank connection T and the tank conduit 66. In this way, priority is given to the power beyond consumer 74, as a result of which, even with a high volumetric flow demand of the power beyond consumer 74, both the consumers 2, 4 and the power beyond consumer 74 are provided with a sufficient supply of pressure fluid, provided that the pump 6 is designed in an appropriate fashion.

The hydraulic control system according to the first exemplary embodiment also assures that in the event of an undersupply of the consumers, the inlet pressure governor 60 closes, thus assuring that the power beyond consumer 74 is given priority over the consumers 2, 4.

Figure 4:
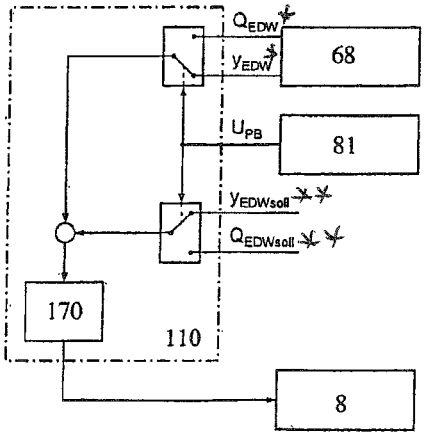

FIGS. 3 and 4, which relate to a second exemplary embodiment of the invention, differ from the first exemplary embodiment only in that in the second exemplary embodiment, the tank conduit 66 is provided with a residual flow sensor 100, which is able to measure the residual volumetric flow from the tank connection T of the inlet pressure governor 60 to the tank line 50. The control unit 110 differs from the control unit 10 of the first exemplary embodiment in that in a state signaled by activation of the power beyond control 81, in which the power beyond consumer 74 is connected and activated, instead of the target value $Y_{IPGtarget}$ of the first exemplary embodiment, a target value $Q_{IPGtarget}$, which represents the residual volumetric flow, is now used as the target value. When the power beyond consumer 74 is connected and activated, in the control unit 110, a switch is made from the path $Y_{IPG}$ to the residual volumetric flow $Q_{IPG}$ for the actual value.

The advantage of the second exemplary embodiment lies in the direct measurement of the residual volumetric flow and the accompanying finer and more precise regulation of the pump regulator 8 in comparison to the first exemplary embodiment.

Figure 5:
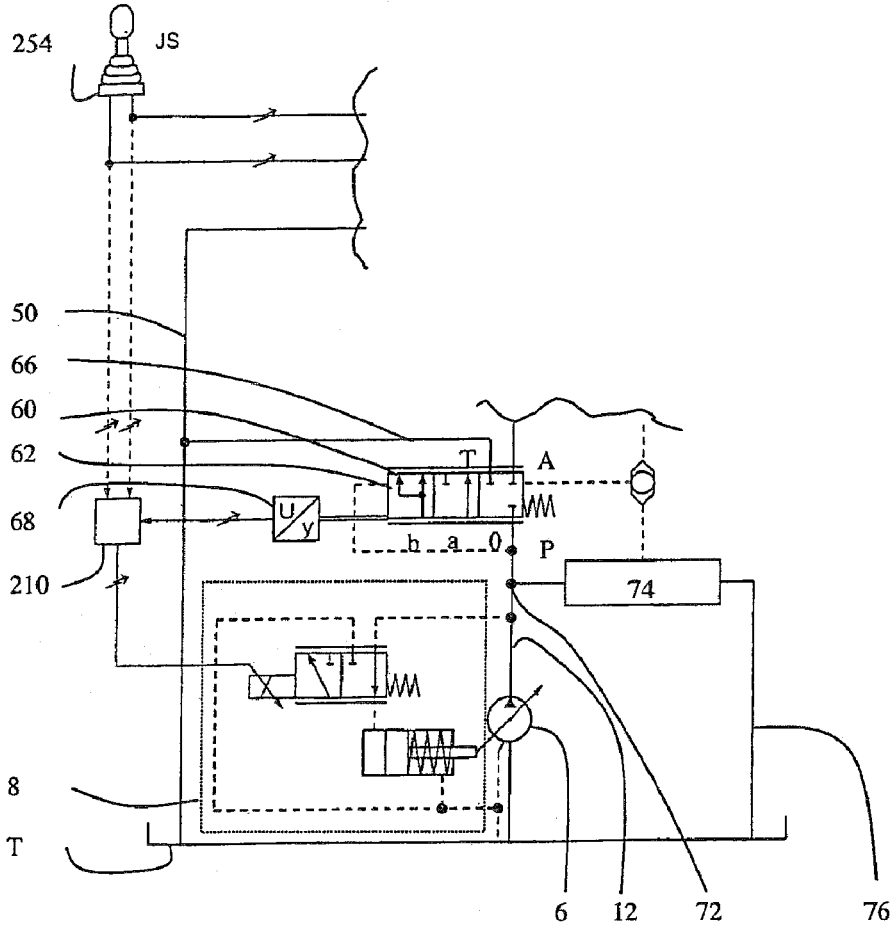
FIGS. 5 and 6 show a hydraulic control system corresponding to a third exemplary embodiment of the present invention.
Figure 6:
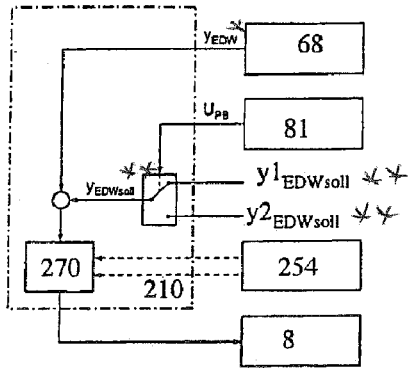

A hydraulic control system corresponding to the third exemplary embodiment that is shown in FIGS. 5 and 6 differs from the hydraulic control system according to the first exemplary embodiment in that now, in lieu of the preliminary control unit 54, which carries out a hydraulic actuation of the control pistons 26, 40 of the directional control valves 24, 38 or a manual actuation in the third exemplary embodiment, a joystick 254 is used, which emits electrical signals that trigger the actuation of the control pistons 26, 40 of the directional control valves 24, 38.

The output signals of the joystick 254 are likewise supplied to the control unit 210 so that as depicted in FIG. 6, in the control unit 210 of the regulator 270, a triggering of the pump regulator 8 is also executed based on the actuation of the joystick 254. This enables a proportional pretriggering of the pump 6 so that the regulating algorithm of the regulator 270 no longer has to compensate for any more than slight regulating deviations for the position regulation of the inlet pressure governor 60. This improves the dynamic transmission properties of the hydraulic control system.

Figure 7:
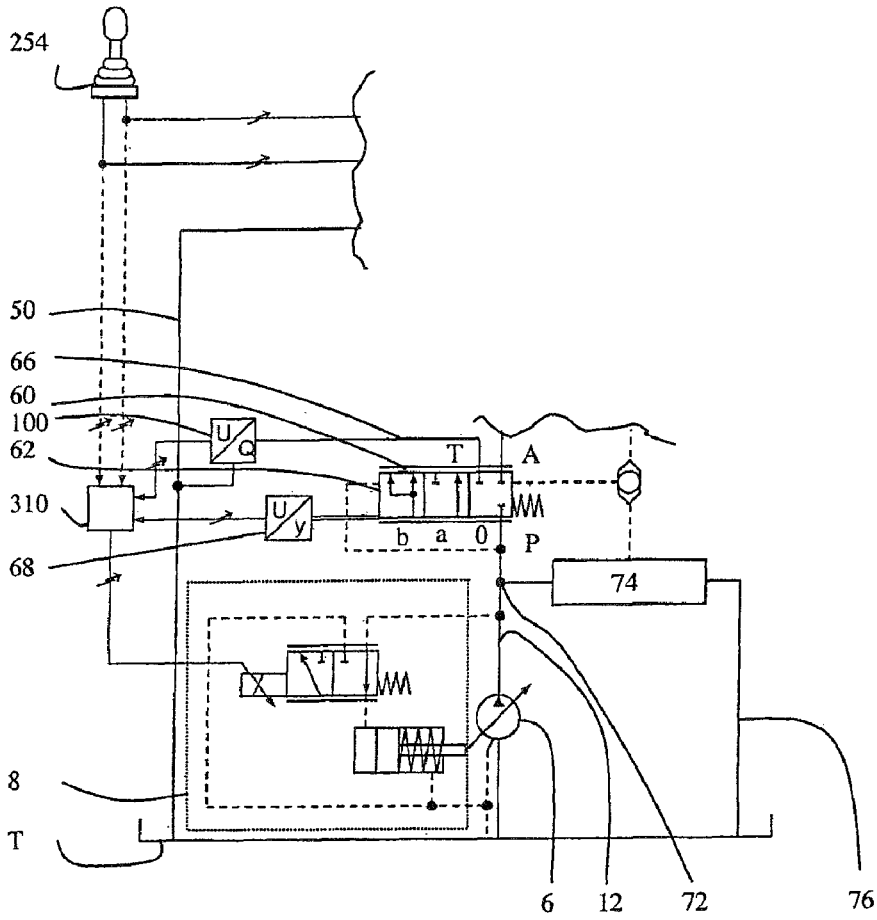
FIGS. 7 and 8 show a hydraulic control system corresponding to a fourth exemplary embodiment of the invention.
Figure 8:
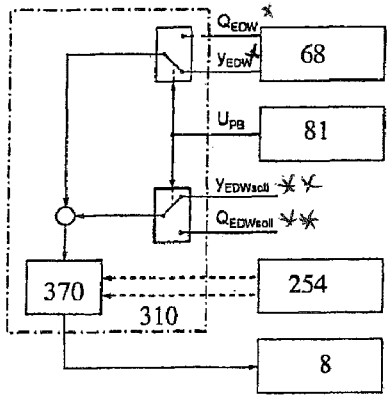

A hydraulic control system according to the fourth exemplary embodiment is shown in FIGS. 7 and 8. This hydraulic control system differs from the hydraulic control system of the second exemplary embodiment only in the use of the joystick 254 in a fashion similar to that of the third exemplary embodiment. Stated more precisely, by contrast with the second exemplary embodiment, now the control unit 310 is additionally supplied with the electrical output signals of the joystick 254 so that the regulating algorithm for the residual flow regulation of the input pressure governor 60 here only has to compensate for slight regulating deviations. This improves the dynamic transmission properties of the hydraulic control system in a fashion similar to the third exemplary embodiment.

Figure 9:
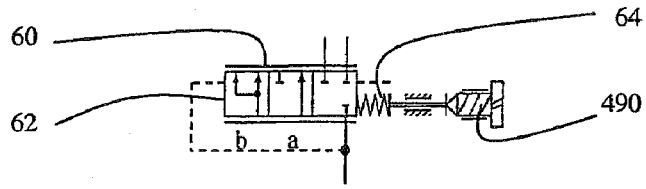
FIGS. 9, 10, and 11 show a fifth, sixth, and seventh exemplary embodiment with regard to a switching-over of the regulating pressure difference of the inlet pressure governor.
Figure 10:
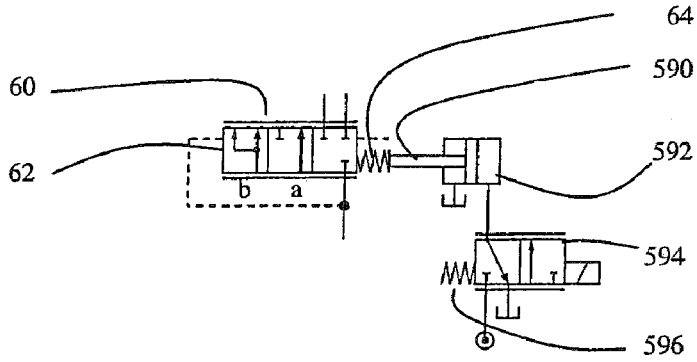
Figure 11:
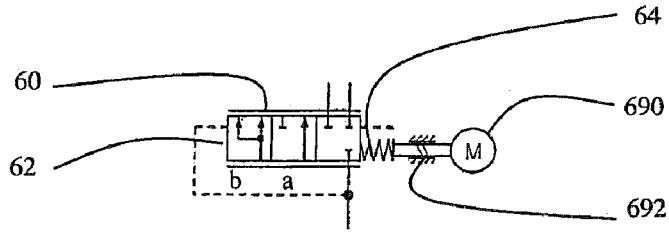

FIGS. 9, 10, and 11 show a fifth, sixth, and seventh exemplary embodiment of the present invention. The prestressing of the spring 64 of the inlet pressure governor 60 is changed mechanically (fifth exemplary embodiment), hydraulically (sixth exemplary embodiment), or electrically (seventh exemplary embodiment). The remaining hydraulic layout in the fifth, sixth, and seventh exemplary embodiment corresponds to that of the first exemplary embodiment.

In the fifth exemplary embodiment that is shown in FIG. 9, the end section of the spring 64, which is situated opposite from the end with which the spring 64 rests against the control piston 62 of the inlet pressure governor 60, rests against an adjusting screw 490, whose relative position can be changed in the movement direction of the control piston 62.

If the power beyond consumer 74 is neither connected nor activated, then the adjusting screw 490 is situated in its position toward the right in FIG. 9, with the target position of the inlet pressure governor being the position a. If the power beyond consumer 74 is connected and activated, then the adjusting screw 490 is situated its position toward the left in FIG. 9, with the position b of the control piston being the target position with increased prestressing force.

In the sixth exemplary embodiment, an adjusting piston 590 of an adjusting cylinder 592 acts on the end section of the spring 64 oriented away from the control piston 62; a cylinder chamber of the adjusting cylinder 592 can be acted on with pressure via a pilot valve 594 in order to produce a movement of the control piston 62 toward the left in FIG. 10. In the neutral position, a spring 596 pushes the control piston of the pilot valve 594 into a position in which the cylinder chamber of the adjusting cylinder 592 is pressure-relieved in the direction of the tank, thus placing the least amount of constraint on the spring 64. With an electrical actuation of the pilot valve 594, the cylinder chamber of the adjusting cylinder 592 is supplied with pressure fluid so that a pressure therein increases, which pressure is able to move the adjusting piston 590 toward the left in FIG. 10 in order to place additional stress on the spring 64.

In the neutral position of the pilot valve 594 and therefore when the cylinder chamber of the adjusting cylinder 592 is pressure-relieved, the adjusting piston 590 is situated in its position toward the right, with the position a of the inlet pressure governor 60 as the target value. With a pressure impingement of the cylinder chamber of the adjusting cylinder 592 via the pilot valve 594, the adjusting piston 590 is brought into its left position in FIG. 10, with the position b of the inlet pressure governor 60 as the target position.

In the seventh exemplary embodiment according to FIG. 11, an electrical actuating motor 690 is provided, which is equipped with a threaded shaft 692. The position of the end section of the spring 64 opposite from the control piston 62 of the inlet pressure governor 60 can be changed through activation of the actuating motor 690. In this case, when the threaded shaft 692 is screwed out from the actuating motor 690, this presets the position b of the inlet pressure governor 60 as the target position. When the threaded shaft 692 is in a screwed-in position, this presets the position a of the control piston 62 of the inlet pressure governor 60.

The fifth, sixth, and seventh exemplary embodiment share the feature that by using only one spring, an increase in the regulating pressure difference can be implemented by increasing the prestressing force of the spring. It is therefore possible to use conventional electronic control devices for the control unit 10, requiring only a slight mechanical, electrical, or hydraulic modification in order to implement the increase in the regulating pressure difference of the inlet pressure governor.

Figure 12:
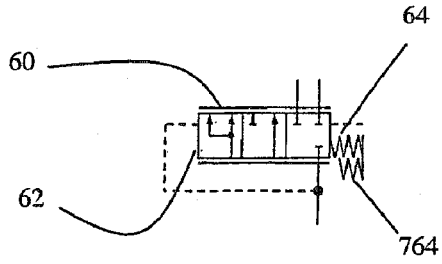
FIGS. 12 and 13 show an eighth exemplary embodiment for the switching-over of the regulating pressure difference of the inlet pressure governor according to the present invention.
Figure 13:
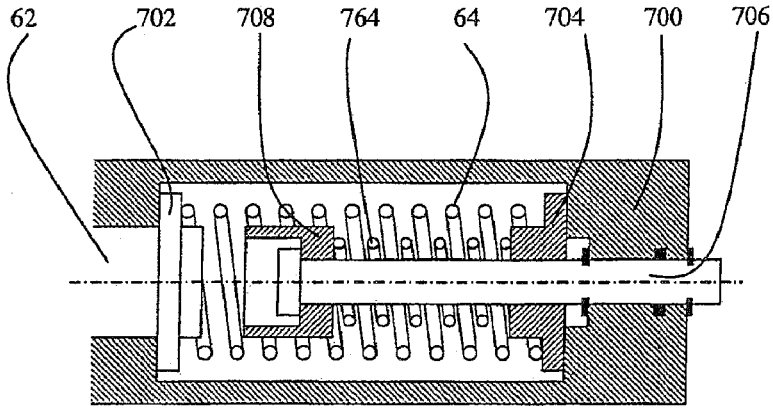
Figure 14:
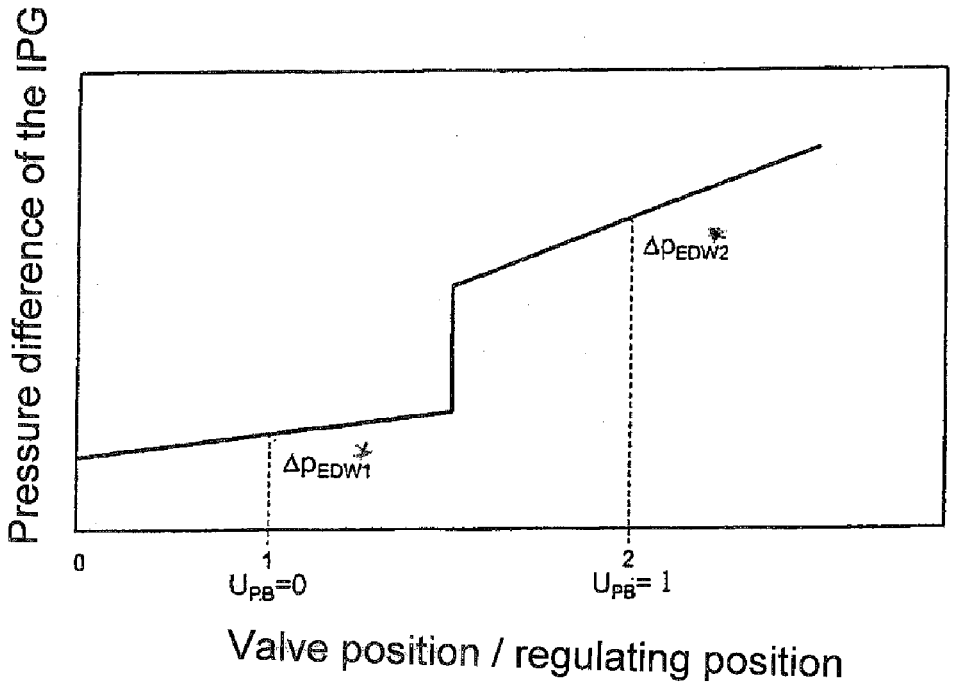
FIG. 14 shows an exemplary characteristic curve of the inlet pressure governor so as to illustrate the pressure increase.

FIGS. 12, 13, and 14 show an eighth exemplary embodiment of the present invention in which, through the use of a spring packet, an automatic increase in the regulating pressure difference of the inlet pressure governor 60 occurs when the regulating position is switched from position a to position b. This takes advantage of the fact that with the activation of a power beyond consumer 74 of the first exemplary embodiment, the regulating position of the inlet pressure governor is shifted further toward the right. A correspondingly higher regulating pressure difference is required in order to reach this regulating position.

By contrast with the first through fourth exemplary embodiments, in the eighth exemplary embodiment, once a predetermined movement distance of the control piston 62 has been reached, an additional spring 764 comes into play in addition to the spring 64.

FIG. 13 shows an example of a structural embodiment for the connection of the additional spring 764. The end section of the control piston 62 of the inlet pressure governor 60 protrudes into a cylindrical housing 700 and is secured in a cylindrical bore by means of the retaining ring 702. This retaining ring 702 likewise supports the spring 64 whose opposite end section is supported on the spring housing 700 by means of a spring retainer 704. Inside the spring 64, a supporting rod 706 is provided, which is fastened in the spring housing 700 by means of retaining rings, for example. A spring plate 708 is supported in sliding fashion on this supporting rod 706 and an end section of the additional spring 764 rests against it. The opposite end section of the additional spring 764 rests against the spring retainer 704.

When the retaining ring 702 is in contact with the retaining housing 700, the force of the spring 64 acts on the retaining ring 702. When the control piston 62 is moved toward the right in FIG. 13, the retaining ring 702 likewise moves toward the right along with the control piston 62, thus compressing the spring 64. This corresponds to a movement of the control piston from the position 0 to the position a in FIG. 1.

After traveling a predetermined distance, the control piston 62 comes into contact with the spring plate 708. With a further movement of the control piston 62 toward the right in FIG. 13, the control piston 62 carries the spring plate 708 along with it, thus compressing the additional spring 764 on the piston rod 106 so that both of the springs 64, 764 are effective. When the control piston 62 comes into contact with the support rod 706, further movement of the control piston 62 toward the right in FIG. 13 is prevented.

Because of the embodiment shown in FIG. 13 it is possible that starting from a predetermined stroke of the control piston 62 toward the right in FIG. 13, which compresses the spring 64, the control piston 62 must also compress the additional spring 764 in order to move further toward the right in FIG. 13, until the control piston 62 comes into contact with the end of the support rod 706 and a further movement of the control piston 62 toward the right in FIG. 13 is prevented. Because of this parallel arrangement of the spring 64 and the additional spring 764, it is possible to achieve very short installation spaces in the housing of the inlet pressure governor 60.

As an alternative to the spring packet of the eighth exemplary embodiment, it is possible in a variant to also use a progressive spring.

FIG. 14 shows an exemplary characteristic curve of the inlet pressure governor 60 with a pressure increase. In it, the pressure difference of the inlet pressure governor is plotted over the valve position or regulating position. This characteristic curve shows that starting from a particular valve position/regulating position, the pressure difference increases from the value $\Delta p_{IPG1}$ to the value $\Delta p_{IPG2}$.

With a hydraulic control system according to one of the preceding exemplary embodiments, it is possible to supply a power beyond consumer 74 in a prioritized fashion in order to maintain the function. An electronically, hydraulically, or mechanically triggered increase in the pressure level occurs only with an activation of the power beyond consumer. As a result, it is possible to achieve a demand-activated, energy-saving supply of all active consumers 2, 4, 74.

The present invention is not limited to the consumers 2, 4 being connected in parallel; the inlet pressure governor can also be connected upstream of only one of the consumers 2, 4. In this case, the other consumer is connected directly to the pressure connection of the pump and is therefore hydraulically prioritized.

What is claimed is:

1. A hydraulic control system for controlling at least two consumers (2, 4), which a pump (6) with an adjustable delivery quantity is able to supply with pressure fluid, wherein each of said at least two consumers is associated with a respective adjustable metering orifice (24, 38), having a power beyond connection (72) to which at least one power beyond consumer (74) is connectable, and having an inlet pressure governor unit (60) that is connected downstream of the pump (6) and that is able to open a connection to a tank (T) and whose setting occurs as a function of a load pressure of the at least two consumers (2, 4) or of the at least one power beyond consumer (74), wherein the inlet pressure governor (60) is provided in the pressure fluid flow path between the pump (6) and at least one of the at least two consumers (2, 4), while the power beyond connection (72) branches off from the pressure fluid path between the pump (6) and the inlet pressure governor (60), and wherein a maximum of the load pressures act on the inlet pressure governor (60) in the closing direction.

2. The control system as recited in claim 1, wherein the pump (6) is controllable as a function of the setting of the inlet pressure governor (60).

3. The control system as recited in claim 2, wherein the pump (6) is controllable as a function of the position of a control piston (62) of the inlet pressure governor (60).

4. The control system as recited in claim 1, wherein the pump (6) is controllable as a function of the volumetric flow at a connection (T) of the inlet pressure governor (60).

5. The control system as recited in claim 1, wherein the pump (6) is controllable as a function of the control of the metering orifice (24, 38) of at least one of said at least two consumers (2, 4).

6. The control system as recited in claim 1, wherein the inlet pressure governor (60) closes the connection to the at least one of the at least two consumers (2, 4) and to the tank (T) in a spring-prestressed starting position and as it is moved in the opening direction, opens the connection first to the at least one of the at least two consumers (2, 4) and then to the tank (T).

7. The control system as recited in claim 1, wherein the inlet pressure governor (60) is acted on in the closing direction by the force of a spring (64) and by the maximum of the load pressures and is acted on in the opening direction by the pressure in it inlet (P).

8. The control system as recited in claim 7, wherein for switching the regulating pressure difference as a function of the spring stroke, the spring acting on the inlet pressure governor (60) in the closing direction is a progressive spring or a spring of a spring packet.

9. The control system as recited in claim 7, equipped with a device (490, 590, 690) for increasing the prestressing force of the spring (64).

10. The control system as recited in claim 9, wherein the device for increasing the prestressing force of the spring (64) is an adjusting screw (490) for mechanically moving the spring support, an adjusting piston (590) for hydraulically moving the spring support, or an actuating motor (690) for electrically moving the spring support.

11. The control system as recited in claim 1, wherein the pump (6) is an electrically controllable variable displacement pump or a speed-regulated fixed displacement pump.

12. The control system as recited in claim 1, wherein each the respective adjustable metering orifice (24, 38) has an individual pressure governor (16, 20) connected upstream of it, which is acted on in the opening direction by a pressure governor spring (56, 58) and by the maximum of the load pressures of the at least two consumers and is acted on in the closing direction by the pressure at the outlet of the respective individual pressure governor (16, 20).

13. The control system as recited in claim 1, wherein the metering orifices are comprised of electrically, hydraulically, or mechanically movable directional control valves (24, 38).

14. The control system as recited in claim 8, wherein said inlet pressure governor (60) has a control piston (62) acted on in a closing direction by the spring packet (64, 764) and acted on in an opening direction by the load pressure, wherein the spring packet has two springs (64, 764) configured to be brought into engagement one after the other.

* * * * *